US008091465B2

(12) United States Patent
Ravid et al.

(10) Patent No.: US 8,091,465 B2
(45) Date of Patent: Jan. 10, 2012

(54) ARMOR MODULE AND AN ARMOR ARRAY USED THEREIN

(75) Inventors: Moshe Ravid, Hod Hasharon (IL); Shlomo Birger, Mizpe Adi (IL); Amit Viesel, D.N. Marom Hagalil (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 439 days.

(21) Appl. No.: 12/285,502

(22) Filed: Oct. 7, 2008

(65) Prior Publication Data

US 2011/0126695 A1 Jun. 2, 2011

(30) Foreign Application Priority Data

Oct. 7, 2007 (IL) ..... 186398

(51) Int. Cl.
*F41H 5/04* (2006.01)

(52) U.S. Cl. ..... 89/36.08; 89/36.02; 89/910; 89/904; 89/903

(58) Field of Classification Search ..... 89/36.02, 89/36.04, 36.11, 36.12, 903, 904, 910, 912, 89/937, 36.08
See application file for complete search history.

(56) References Cited

U.S. PATENT DOCUMENTS

| | | | | | |
|---|---|---|---|---|---|
| 787,065 | A | * | 4/1905 | White | 89/36.02 |
| 2,279,110 | A | * | 4/1942 | Collins | 89/36.02 |
| 2,348,130 | A | * | 5/1944 | Hardy, Jr. | 89/36.02 |
| 2,380,393 | A | * | 7/1945 | Berg | 89/36.02 |
| 2,477,852 | A | | 8/1949 | Bacon | |
| 3,765,299 | A | | 10/1973 | Pagano et al. | |
| 3,962,976 | A | * | 6/1976 | Kelsey | 89/36.02 |
| 4,036,104 | A | * | 7/1977 | Pagano et al. | 89/36.02 |
| 4,125,053 | A | | 11/1978 | Lasker | |

(Continued)

FOREIGN PATENT DOCUMENTS

EP 1746379 A1 1/2007

(Continued)

OTHER PUBLICATIONS

European Search Report, EP 08 10 5504, of the corresponding European Application, completed on Feb. 9, 2011.

*Primary Examiner* — Michael Carone
*Assistant Examiner* — Jonathan C Weber
(74) *Attorney, Agent, or Firm* — The Nath Law Group; Susanne M. Hopkins; William L. Klima

(57) ABSTRACT

According to the present invention there is provided an armor array for protecting a body to be protected from an incoming projectile having an anticipated impact direction. The armor array is constituted by at least a first and a second armor cassette, each comprising a top base plate and a bottom base plate sandwiching therebetween an expandable layer. The first and second armor cassettes are spaced apart by an intermediate depressible panel having a top and a bottom face, such that the bottom base plate of the first armor cassette faces the top face of the intermediate depressible panel and the top base plate of the second cassette faces the bottom face of the intermediate depressible panel. The armor array is constructed such that upon expansion of the expandable layer, caused by the impact of the incoming projectile, at least one of the bottom base plate of the first armor cassette and the top base plate of the second armor cassette is urged towards the intermediate depressible panel and depresses it.

20 Claims, 2 Drawing Sheets

U.S. PATENT DOCUMENTS

| | | | | | |
|---|---|---|---|---|---|
| 4,198,454 | A | * | 4/1980 | Norton | 89/36.02 |
| 4,404,889 | A | * | 9/1983 | Miguel | 89/36.02 |
| 4,529,640 | A | * | 7/1985 | Brown et al. | 89/36.02 |
| 4,567,100 | A | * | 1/1986 | Pickett et al. | 52/309.13 |
| 4,836,084 | A | * | 6/1989 | Vogelesang et al. | 89/36.02 |
| 4,895,063 | A | * | 1/1990 | Marlow et al. | 89/36.02 |
| 4,965,138 | A | * | 10/1990 | Gonzalez | 89/36.02 |
| H1061 | H | * | 6/1992 | Rozner et al. | 89/36.02 |
| 5,349,893 | A | * | 9/1994 | Dunn | 89/36.02 |
| 5,398,592 | A | * | 3/1995 | Turner | 89/36.02 |
| 5,452,641 | A | | 9/1995 | Kariya | |
| 5,471,905 | A | * | 12/1995 | Martin | 89/36.02 |
| 5,499,568 | A | * | 3/1996 | Turner | 89/36.02 |
| 5,670,734 | A | * | 9/1997 | Middione et al. | 89/36.04 |
| 6,082,240 | A | * | 7/2000 | Middione et al. | 89/36.04 |
| 6,138,275 | A | * | 10/2000 | Sacks | 89/36.05 |
| 6,418,832 | B1 | | 7/2002 | Colvin | |
| 6,698,331 | B1 | * | 3/2004 | Yu et al. | 89/36.02 |
| 7,080,587 | B2 | | 7/2006 | Benyami et al. | |
| 7,601,654 | B2 | * | 10/2009 | Bhatnagar et al. | 89/36.01 |
| 2004/0118271 | A1 | * | 6/2004 | Puckett et al. | 89/36.02 |
| 2006/0048640 | A1 | * | 3/2006 | Terry et al. | 89/36.02 |

FOREIGN PATENT DOCUMENTS

| | | | |
|---|---|---|---|
| FR | 2803379 | A1 | 7/2001 |
| WO | 2006/074685 | A1 | 7/2006 |

* cited by examiner

ARMOR MODULE AND AN ARMOR ARRAY USED THEREIN

FIELD OF THE INVENTION

This invention relates to a reactive armor adapted to protect a body from an incoming projectile, in particular against projectiles such as shaped charges and explosive formed charges (EFP), by ensuring that the energy of the projectile's impact on the armor causes a reaction during the course of which, an armor element of the armor is propelled toward the projectile in order to absorb its energy.

BACKGROUND OF THE INVENTION

The present invention particularly relates to a reactive armor which includes an array of armor cassettes each comprising armor plates sandwiching between them the energetic material.

Most of such armor cassettes are designed such that, when an incoming projectile impacts one of the armor plates, it triggers a reaction in the energetic material causing it to expand rapidly, thereby propelling the armor plates in opposite directions.

Such armor has been shown to be very effective against such projectiles as directional jets or long penetrator projectiles, in particular, if the armor cassettes are mounted onto the body to be protected at an angle to the anticipated direction of incoming threat.

SUMMARY OF THE INVENTION

According to one aspect of the present invention there is provided an armor array for protecting a body to be protected from an incoming projectile having an anticipated impact direction, said armor array being constituted by at least a first and a second armor cassette, each comprising a top base plate and a bottom base plate sandwiching therebetween an expandable layer, said first and second armor cassettes being spaced apart by an intermediate depressible panel having a top and a bottom face, such that the bottom base plate of said first armor cassette faces the top face of said intermediate depressible panel and the top base plate of said second cassette faces the bottom face of said intermediate depressible panel, wherein said armor array is constructed such that upon expansion of the expandable layer, caused by the impact of said incoming projectile, at least one of the bottom base plate of said first armor cassette and the top base plate of said second armor cassette is urged towards said intermediate depressible panel and depresses it said intermediate depressible panel.

According to another aspect of the present invention there is provided an armor module comprising a housing containing the armor array as described above, said housing being constructed for mounting onto said body to be protected.

The housing of said armor module may have at least one of the front and rear walls and support walls, such that when mounted onto said body to be protected, the front of the housing faces the anticipated impact direction for which said armor module is designed, and the rear of the housing faces said body to be protected.

The front and/or rear wall of said housing may be formed with a main mounting arrangement allowing mounting said armor module onto said body to be protected. Said housing may further be formed with an auxiliary mounting arrangement allowing attachment of said armor array to said housing, e.g. at its front or rear or support walls.

The housing, the main mounting arrangement and the auxiliary mounting arrangement may all be made of metallic material, e.g. steel.

Said armor array may comprise a plurality of armor cassettes and a plurality of depressible panels, which may all be densely packed as an array, at least the majority of the cassettes having the intermediate depressible panel adjacent at least one of its top and bottom base plates. The term 'densely packed' is used herein to refer to an array in which the distance between the top/bottom base plate of one armor cassette and an adjacent face of the depressible panel is considerably less than the thickness of the armor cassette or the depressible panel, the thinner of the two.

The armor array may be assembled such that the armor cassettes and depressible panels are arranged in an alternating order, i.e. cassette-panel-cassette-panel etc.

According to one example, the armor cassettes and depressible panels are only attached to the housing of the armor module. According to another example, the armor cassettes and depressible panels may be attached to each other, for example, by an adhesive, e.g. glue, resin etc. to form an essentially robust armor array.

The armor array may be designed such that, when said armor module is mounted on the body to be protected, the armor cassettes are slanted, i.e. at an angle, e.g. about 60° to the anticipated impact direction of said incoming projectile. In this connection, it should be explained that the "anticipated impact direction" in the present specification and claims means a direction generally perpendicular to the surface of a body to be protected, on which the armor is constructed to be mounted. In other words, if the surface of a body to be protected is generally vertical, the anticipated impact direction is generally horizontal.

The base plates of each of said armor cassettes may have a thickness of about 1-5 mm and may be made of metallic material, e.g. steel. Alternatively, said base plates may be made of composite material, having properties chosen so as to provide similar ballistic characteristics as those of the steel base plate.

Said expandable layer may have a thickness of about 2-8 mm, and be made of an essentially low density energetic material. One example of such a material may be Polyoxymethylane (POM) which has a density of about 1-2.5 g/cm$^3$. However, it should be appreciated that a variety of other materials may be used such as rubber, plastic or composite materials, glued or otherwise combined to form said expandable layer.

Said intermediate depressible panel may be have a thickness of about 10-30 mm and may have a low density of about 0.2-1 g/cm$^3$.

According to one example, the intermediate layer may be constituted by a single body made of a depressible material, for example, rubber, metallic foam, plastic, aluminum (AL), polycarbonate (PC), polyurethane (PU) etc. According to another example, the depressible panel may be an assembly of elements, constructed such that the assembly has depressible characteristics, for example, a depressible structure.

According to the latter example, the depressible structure may be of a rib type, i.e. made of a plurality of thin elements extending between said top and said bottom face of the depressible panel, said thin elements being made of deformable material and constructed for deformation under pressure applied thereon. According to a specific example, the thin elements may be may be made of aluminum, aluminum alloy etc., and may be arranged to form a pattern, e.g. a honeycomb structure. One advantage of the honeycomb structure is that on one hand, it is constructed to maintains a rigid form, even under the pressure of the weight of the armor cassettes positioned above it (i.e. even the lower most depressible panel is adapted not to deform under the weight of the entire array above it), and on the other hand, once sufficient pressure is applied thereto at a specific point, e.g. by propulsion of a base plate in its direction due to expansion of the expandable layer, the honeycomb structure at that point is constructed to deform, generally leading to complete collapse of the entire honeycomb structure.

The intermediate depressible panel may further comprise two skin layers attached to the top and bottom faces thereof. Each skin layers may be made of a variety of material ranging from rubber, through aluminum, and even steel. The arrangement is such that each skin layer faces the base plate of an adjacent armor cassette. The skin layer may provide, inter alia, the following advantages:

a) effectively increasing the thickness of the base plates of the armor cassettes, thereby increasing the armor cassette's ballistic characteristics enabling it to better withstand the impact of the incoming projectile; and b) in the case of a collapsible structure, may facilitate in attachment (e.g. gluing) of the base plate of the armor cassette to the depressible panel.

In operation, the expandable layer of an armor cassette, upon impact of said projectile, expands, causing the base plates to be propelled in opposite directions. Since each base plate is adjacent a depressible panel, the base plates tend to be propelled in the direction of the depressible panel to which they are adjacent and expand into it. More particularly, the base plates expand while applying pressure on the intermediate depressible panel. With particular reference to a previous example, this expansion is achieved by the plates deforming the aluminum honeycomb structure. This allows better absorption of the kinetic energy of said incoming projectile.

The armor module according to the present invention may be particularly effective against jet or similar penetrators made of copper or other dynamically stretched metals and alloys, for example, Shaped Charges (SC) and EFP. The thickness of the armor module along the anticipated impact direction may be determined, inter alia, according to the length of the incoming projectile from which said body is to be protected, its expected energy and the arrangement of the armor cassettes and depressible panels. In particular, a more dense array of armor cassettes, i.e. thinner depressible panels between cassettes, may allow reducing the overall thickness of the armor module. However, it should be mentioned that there exists a lower limit for the thickness of the depressible panel in order for the armor module to functions as intended. This lower limit may be about 15 mm. In general, said armor module may have a thickness of about 400÷450 mm, and have a weight of 250÷750 Kg/m$^2$.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1A:
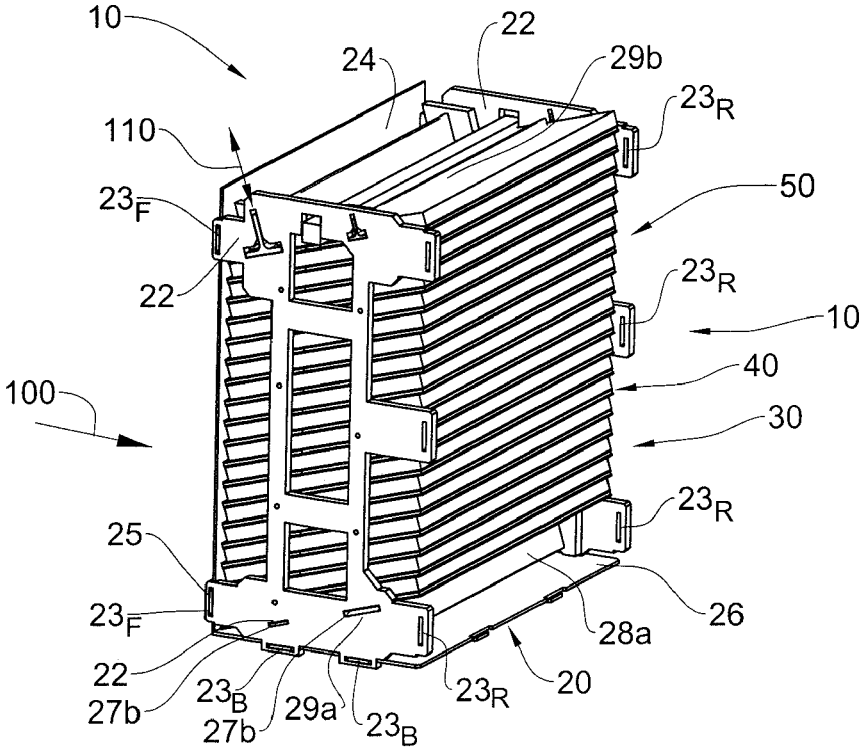
FIG. 1A is an isometric front view of an armor module according to one example of the present invention.

With reference to FIG. 1A, an armor module generally designated 10 is shown comprising a housing 20 and a densely packed array 30 of armor cassettes 40. The armor module 10 is constructed to be mounted on a body to be protected (60, partially shown FIG. 2) in order to protect it from an incoming penetrator, the anticipated impact direction of which is denoted by arrow 100.

The housing 20 is formed of two main support walls 22, and a front armor plate 24 and a bottom plate 26 attached to the main support walls 22. The housing 20 is encompassed by a cover C made of continuous sheet of metal having a top surface T, a bottom surface B (not shown) and two side surfaces S.

Figure 1B:
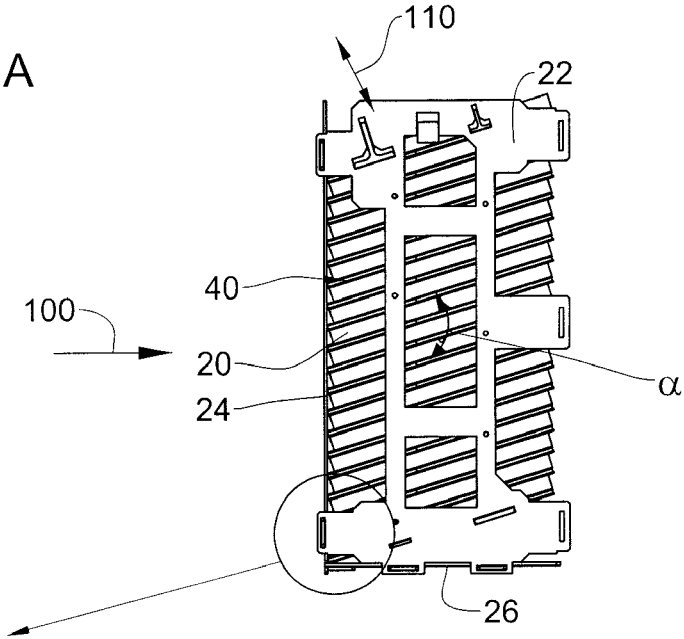
FIG. 1B is a side view of the armor module of FIG. 1A.
Figure 1C:
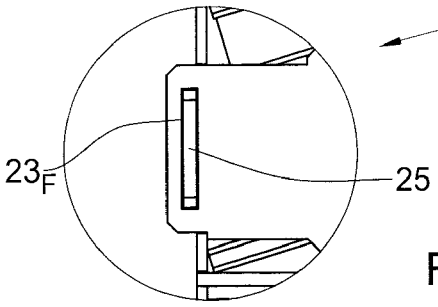
FIG. 1C is an enlarged view of detail A in FIG. 1B.

The front armor plate 24 is attached to the support walls 22 using a plurality of protrusions 25 inserted into extended portions of the support walls 22 having slits $\mathbf{23}_F$ formed therein (shown FIG. 1C). The bottom plate 26 is also attached to the support walls 22 using a plurality of protrusions 25 inserted into extended portions of the support walls 22 having slits $\mathbf{23}_B$ formed therein.

The housing 20 is further formed with a support 28 adapted to support the armor array 30. The support 28*a* is attached to the support walls 22 via protrusions 29*a* inserted into corresponding slits 27*b* formed in the support walls 22.

The housing is also formed with a top limiter 29*b*, positioned at the top of the array 30, and adapted to restrain the armor array 30. The top limiter 29*b* is formed with shaped protrusions 28*b* constructed to be inserted into shaped slits 27*b* of the support walls 22, in order to allow slight movement of the limiter 29*b* along the extensions of the slit 27*b* during operation, as denoted by arrow 110.

The support walls 22 of the housing are further formed with extensions formed with slits $\mathbf{23}_R$ constructed for attachment of the armor module 10 to the body (60, partially shown FIG. 2) to be protected during mounting as will be discussed later with respect to FIG. 2.

The armor array 30 is constituted by a plurality of armor cassettes 40, each two adjacent cassettes being spaced apart by a depressible panel 50. In the discussed example, the armor cassettes 40 and depressible panels 50 are glued to each other such that the armor array 30 is robust and acts like a single unit.

Figure 3:
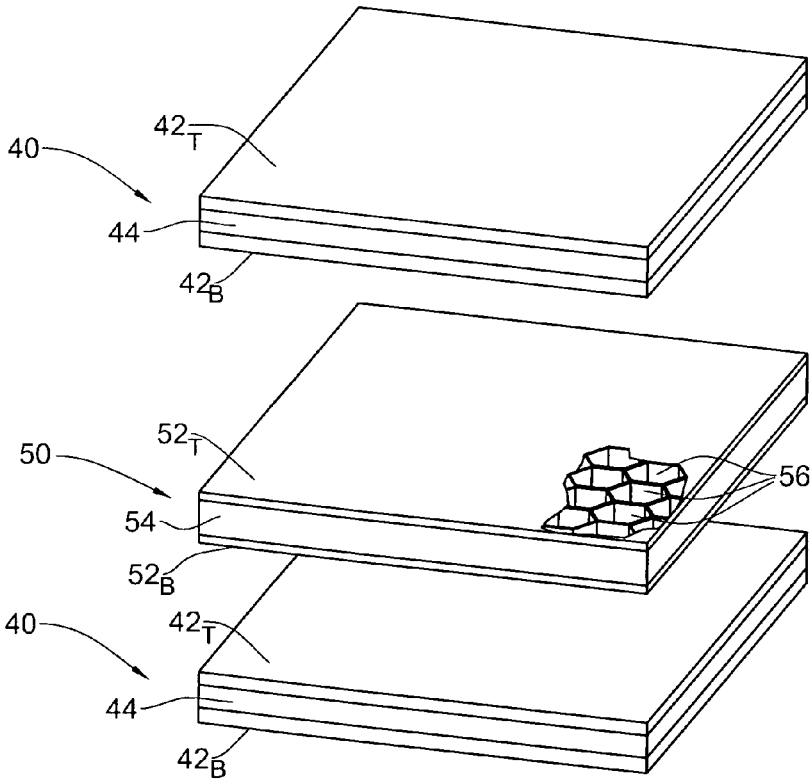
FIG. 3 is an exploded view of two armor cassettes and a honeycomb layer, constituting a part of the armor module shown in FIGS. 1A to 1C.

Turning to FIG. 3, each armor cassette 40 is formed of a top base plate $\mathbf{42}_T$ and a bottom base plate $\mathbf{42}_B$, between which a layer of expandable material 44 is confined. The base plates $\mathbf{42}_T$, $\mathbf{42}_B$ are made of 1÷5 mm steel, and the expandable material 44 is made of 2÷8 mm Polyoxymethilane. However, it should be noted that the expandable material may be any material adapted to expand under impact of a penetrator, and may be rubber, plastic, composite materials etc.

The depressible panel 50 is in the form of a structure 54 constituted by aluminum ribs 56 arranged to form the honeycomb pattern. The honeycomb structure 54 is covered on top and bottom faces by rubber skin layers $\mathbf{52}_T$ and $\mathbf{52}_B$ respectively. However, it would be appreciated that the depressible panel may also be in the form of a single body made of depressible material, for example, metallic foam, or other filler material such as plastic, Polycarbonate, etc.

Turning now to FIG. 1B, the cassettes 40 and depressible panels 50 of the armor array are arranged at an angle $\alpha \approx 60°$ to the anticipated impact direction of an incoming projectile, and the armor module 10 thus has an overall width W≈400÷450 mm in this direction.

Figure 2:
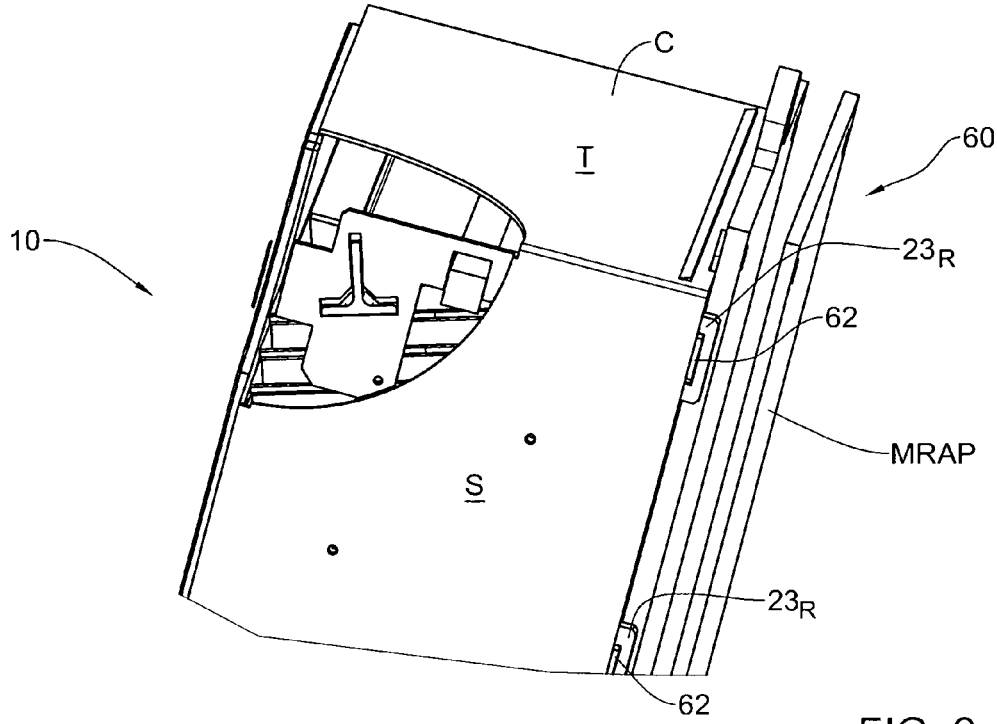
FIG. 2 is an isometric side view of the armor module shown in FIGS. 1A to 1C when mounted on a body to be protected.

With reference to FIG. 2, the armor module 10 is shown mounted on a body to be protected 60. The slits $\mathbf{23}_R$ are adapted to receive corresponding protrusions of the side wall 62 of the body 60.

In operation, upon impact of an incoming penetrator (not shown), the expandable layer 44 expands, thereby causing the base plates $\mathbf{42}_T$, $\mathbf{42}_B$ to perform an outward movement, i.e. increasing the distance between one another. However, since the top plate $\mathbf{42}_T$ is restricted from above by one depressible panel 50, and the bottom plate $\mathbf{42}_B$ is restricted from below by another depressible panel 50, the base plates $\mathbf{42}_T$, $\mathbf{42}_B$ are forced to depress the depressible panel 50 by causing deformation of the honeycomb structure 54 thereof. This depression provides absorption of a considerable amount of the kinetic energy of the incoming penetrator.

It should also be noted that since the armor cassettes 40 and the depressible panels 50 are glued to each other, each of the base plates $\mathbf{42}_T$, $\mathbf{42}_B$ is glued to the rubber skin $\mathbf{52}_B$, $\mathbf{52}_T$ of the respective adjacent depressible panels 50. Being glued to an elastic material such as the rubber skin 52, allows increasing the overall fracture toughness of the base plate 42, i.e. increasing, with respect to a base plate 42 not having a rubber skin 52 glued thereto, the time t after which the base plate 42 breaks as a result of the impact. This feature allows the base plate 42, and consequently the entire armor module 10 to withstand the impact of a longer penetrator. It would also be noted that any remains of the penetrator able to penetrate through the armor module 10, may be stopped by an armor of the body.

Those skilled in the art to which this invention pertains will readily appreciate that numerous changes, variations, and modifications can be made without departing from the scope of the invention, mutatis mutandis.

The invention claimed is:

1. An armor array for protecting a body to be protected from an incoming projectile having an anticipated impact direction, said armor array comprising:

at least a first and a second reactive armor cassette, each comprising a top base plate and a bottom base plate sandwiching therebetween an expandable layer, said first and second armor cassettes being spaced apart by an intermediate depressible panel having a top and a bottom face, such that the bottom base plate of said first armor cassette faces the top face of said intermediate depressible panel and the top base plate of said second cassette faces the bottom face of said intermediate depressible panel, wherein said armor array is constructed such that the armor cassettes are inclined with respect to an adjacent surface of the body to be protected, wherein said armor array is constructed such that upon expansion of the expandable layer, caused by the impact of said incoming projectile, at least one of the bottom base plate of said first armor cassette and the top base plate of said second armor cassette is urged towards said intermediate depressible panel and depresses said intermediate depressible panel.

2. An armor array according to claim 1, wherein said armor array is a densely packed armor array.

3. An armor array according to claim 1, wherein said armor array comprises a plurality of armor cassettes spaced apart by a plurality of intermediate depressible panels.

4. An armor array according to claim 1, wherein the armor cassettes and intermediate depressible panel are arranged in an alternating order.

5. An armor array according to claim 1, wherein at least one of said armor cassettes is attached to said depressible panel by an adhesive.

6. An armor array according to claim 1, wherein said intermediate depressible panel is constructed to maintain rigid form under the weight of an armor cassette/s positioned above it, while being adapted to deform under pressure applied thereto as a result of an armor cassette urged thereto due to expansion of said expandable layer.

7. An armor array according to claim 1, wherein said intermediate depressible panel is constituted by a single body made of a depressible material.

8. An armor array according to claim 7, wherein said material is one selected from the group consisting of rubber, metallic foam, plastic, aluminum (AL), polycarbonate (PC), and polyurethane (PU).

9. An armor array according to claim 1, wherein said intermediate depressible panel is an assembly of elements arranged to form a depressible structure.

10. An armor array according to claim 9, wherein said assembly is made of thin deformable rib elements extending between said top and said bottom face of the intermediate depressible panel.

11. An armor array according to claim 10, wherein said deformable rib elements are made of aluminum.

12. An armor array according to claim 10, wherein said rib elements form a honeycomb structure.

13. An armor array according to claim 12, wherein said honeycomb structure extends at least 15 cm between said top base plate of said second armor cassette and said bottom base plate of said first armor cassette.

14. An armor array according to claim 1, wherein said intermediate depressible layer further comprises at least one skin layer, attached to one of said top and said bottom face of the intermediate depressible panel.

15. An armor array according to claim 1, wherein said armor array is constructed to be received within a housing of an armor module, said armor module being constructed for mounting onto a body to be protected.

16. An armor array according to claim 15, wherein said housing has a front side and a rear side, such that when mounted onto said body to be protected, said front side is facing the anticipated impact direction of the incoming projectile, and said rear side is facing said body to be protected.

17. An armor array according to claim 13, wherein said armor module has a weight of about 250-750 $Kg/m^2$.

18. An armor module constructed for mounting onto a body to be protected for protecting said body from an incoming projectile having an anticipated impact direction, said armor module comprising:

a housing and an armor array for protecting a body to be protected from an incoming projectile having an anticipated impact direction, said armor array comprising at least a first and a second reactive armor cassette, each comprising a top base plate and a bottom base plate sandwiching therebetween an expandable layer, said first and second armor cassettes being spaced apart by an intermediate depressible panel having a top and a bottom face, such that the bottom base plate of said first armor cassette faces the top face of said intermediate depressible panel and the top base plate of said second cassette faces the bottom face of said intermediate depressible panel, wherein said armor array is constructed such that upon expansion of the expandable layer, caused by the impact of said incoming projectile, at least one of the bottom base plate of said first armor cassette and the top base plate of said second armor cassette is urged towards said intermediate depressible panel and depresses said intermediate depressible panel, wherein said armor array is constructed such that the armor cassettes are inclined with respect to an adjacent surface of the body to be protected.

19. An armor module according to claim 18, wherein said armor module has a weight of about 250-750 $Kg/m^2$.

20. An armor array for protecting a body to be protected from an incoming projectile having an anticipated impact direction, said armor array comprising:

at least a first and a second armor cassette, each comprising a top base plate and a bottom base plate sandwiching therebetween an expandable layer, said first and second armor cassettes being spaced apart by an intermediate depressible panel having a top and a bottom face, such that the bottom base plate of said first armor cassette faces the top face of said intermediate depressible panel and the top base plate of said second cassette faces the bottom face of said intermediate depressible panel, said armor array is constructed such that the armor cassettes are inclined with respect to an adjacent surface of the body to be protected, said armor array is constructed such that upon expansion of the expandable layer, caused by the impact of said incoming projectile, at least one of the bottom base plate of said first armor cassette and the top base plate of said second armor cassette is urged towards said intermediate depressible panel and depresses said intermediate depressible panel, wherein said intermediate depressible panel is constructed to maintain rigid form under the weight of an armor cassette/s positioned above it, while being adapted to deform under pressure applied thereto as a result of an armor cassette urged thereto due to expansion of said expandable layer.

* * * * *